United States Patent [19]

Daly, Jr. et al.

[11] Patent Number: 4,948,150

[45] Date of Patent: Aug. 14, 1990

[54] VOLLEYBALL PRACTICE SYSTEM

[76] Inventors: Richard E. Daly, Jr., 2432 Thomas St., Flint, Mich. 48504; Richard Holland, 5770 Cobb Rd., Lapeer, Mich. 48446

[21] Appl. No.: 378,586

[22] Filed: Jul. 11, 1989

[51] Int. Cl.[5] ..... A63B 69/00

[52] U.S. Cl. ..... 273/411; 273/58 C

[58] Field of Search ..... 273/411, 1.5 R, 1.5 A, 273/26 E, 26 EA, 29 A, 58 C

[56] References Cited

U.S. PATENT DOCUMENTS

| | | | |
|---|---|---|---|
| 660,787 | 10/1900 | Bissell | 273/58 C |
| 2,697,603 | 12/1944 | Haines | 273/1.5 A |
| 3,288,466 | 11/1966 | Cummings | 273/1.5 A |
| 3,602,504 | 8/1971 | Chapman et al. | 273/1.5 R |
| 3,897,950 | 8/1975 | Keller | 273/411 |
| 4,022,471 | 5/1977 | Keller | 273/411 |
| 4,093,234 | 6/1978 | Barton | 273/58 C X |
| 4,296,925 | 10/1981 | Alston | 273/1.5 A |
| 4,372,561 | 2/1983 | Morgan et al. | 273/411 |
| 4,621,811 | 11/1986 | Campbell | 273/1.5 A |
| 4,798,390 | 1/1989 | Dooley | 273/411 |

*Primary Examiner*—William H. Grieb

*Attorney, Agent, or Firm*—James C. McLaughlin

[57] ABSTRACT

A device for the practice of the running-jumping-striking volleyball maneuver known as spiking including an elevated volleyball tethered below an essentially horizontal backstop by a flexible funicular rod. The backstop and flexible funicular rod serve rapidly to damp the kinetic energy imparted by spiking. The flexible funicular rod may also serve to impart a realistic feel to the person using the device to practice spiking. Elevated support for the volleyball is provided by an adjustable arm clamped to a volleyball net's end post or, alternatively, by an arm detachably mounted to the hoop of a basketball net. The device may be assembled, erected, and used by one person.

29 Claims, 4 Drawing Sheets

VOLLEYBALL PRACTICE SYSTEM

TECHNICAL FIELD OF THE INVENTION

The technical field of the present invention is that of devices and methods for facilitating the practice of skills used in the playing of the game of volleyball. Specifically, the present invention concerns devices and methods to be used for volleyball practice by as few as one person.

BACKGROUND INFORMATION

One of the necessary skills used in playing the game of volleyball is spiking. Spiking involves one player projecting the volleyball into the air and a team member striking the elevated ball forwards and downwards with the object of causing the volleyball to strike the floor on the opposing team's side of the net. Generally, spiking involves running towards an elevated volleyball, jumping up towards the volleyball, and striking the volleyball somewhat above its center of gravity. It is emphasized that the skill of spiking involves imparting significant forward and downward momentum to a volleyball by a player who is moving both vertically and horizontally. The skill of spiking a volleyball is not merely one of jumping up and hitting a volleyball. The skill of spiking a volleyball is quite distinct from those skills employed in other ball games such as basketball where the ball is either thrown or deflected. The conventional method of practicing this skill is to have one person project a volleyball (called "setting") and to have a second person spike the volleyball over the net. The conventional method is time consuming in that cooperation and coordination between two or more persons is required (only one of whom can practice spiking), and significant time and effort must be expended to recover the volleyballs after they have been spiked.

It is known in the somewhat related art of basketball practice devices to suspend a basketball in the air for the practicing of jumping skills as they relate to playing basketball. U.S. Pat. Nos. 2,697,603 and 4,621,811 disclose such devices and their expected use in practicing the basically vertical jumping and tapping skill used in the game of basketball. Such devices are inappropriate and ineffective as devices for practicing the spiking of volleyballs as the striking required by the spiking of a volleyball would cause undesirable wild and sustained oscillations of the ball or the wrapping of the ball's tether rope around its support. Furthermore, U.S. Pat. No. 2,697,603 discloses such a short stiff tether that one practicing spiking is likely occasionally to strike the supporting arm and experience an unrealistic feel when striking the ball.

U.S. Pat. No. 4,296,925 discloses a jump training device comprising a ball tethered 12 inches below a pair of vertical or slightly inclined beat boards. It is further disclosed that the device is intended for the rhythmic practice of vertical jumping and striking of a ball. The intentional underdamped action of the ball make this type of device undesirable for the practice of spiking as it is described above.

A need remains in the art of devices for the practice of the spiking of a volleyball for a device that suspends a volleyball in such a manner that the volleyball will be returned quickly to rest after being spiked while giving reasonable safety to the player and providing a realistic feel.

SUMMARY OF THE INVENTION

The present invention is a device for practicing volleyball spiking that satisfies the aforementioned needs in the art and entails suspending a retained volleyball below a horizontal backstop using a flexible cord, rope, tube, or rod (hereinafter called a flexible funicular rod[1]). The preferred embodiment of the present invention uses materials that have dissipative properties so that a spiked volleyball will quickly return to rest while the backstop is kept far enough away from the volleyball as to make the accidental striking of the backstop unlikely and the flexible funicular rod is made appropriately elastic so as to cause the volleyball to have a realistic feel when spiked.

[1]The name "funicular rod" includes cord, rope, tube, and rod forms.

While any scheme for supporting the device of the present invention above the floor is encompassed, the preferred embodiment supports the device with an adjustable vertical and horizontal member clamped to a post and an alternative embodiment supports the device on a projection attached to the rim of a basket ball hoop.

The preferred embodiment and the alternative embodiment use a round flat backstop covered with vinyl laminated fabric; a plastic mesh bag for retaining the volleyball; and surgical tubing for suspending the retained volleyball.

DETAILED DESCRIPTION OF THE INVENTION AND ITS PREFERRED EMBODIMENT

Figure 1:
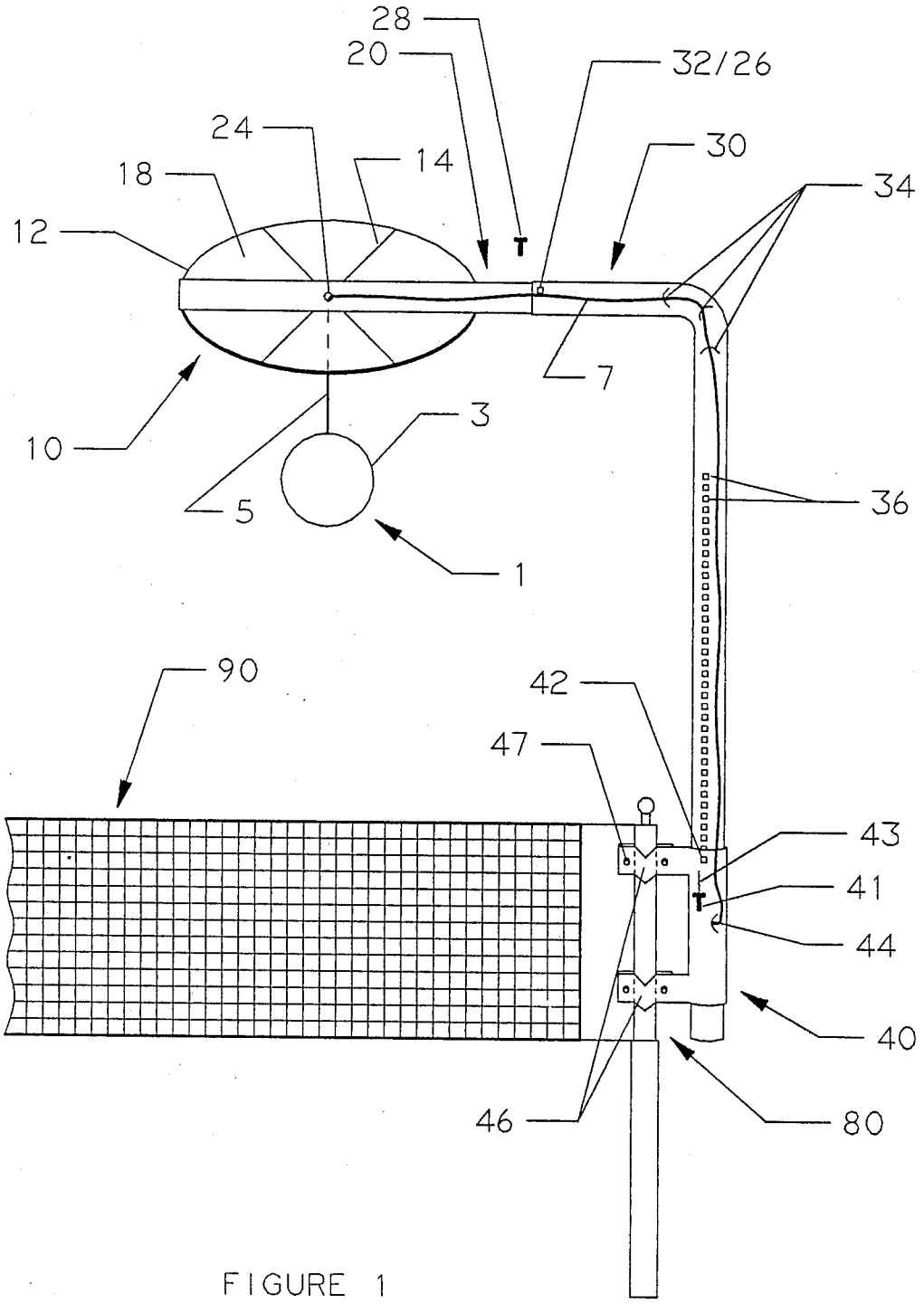
FIG. 1 is a perspective view of the preferred embodiment of the practice device attached to an end post that is supporting a volleyball net.
Figure 2:
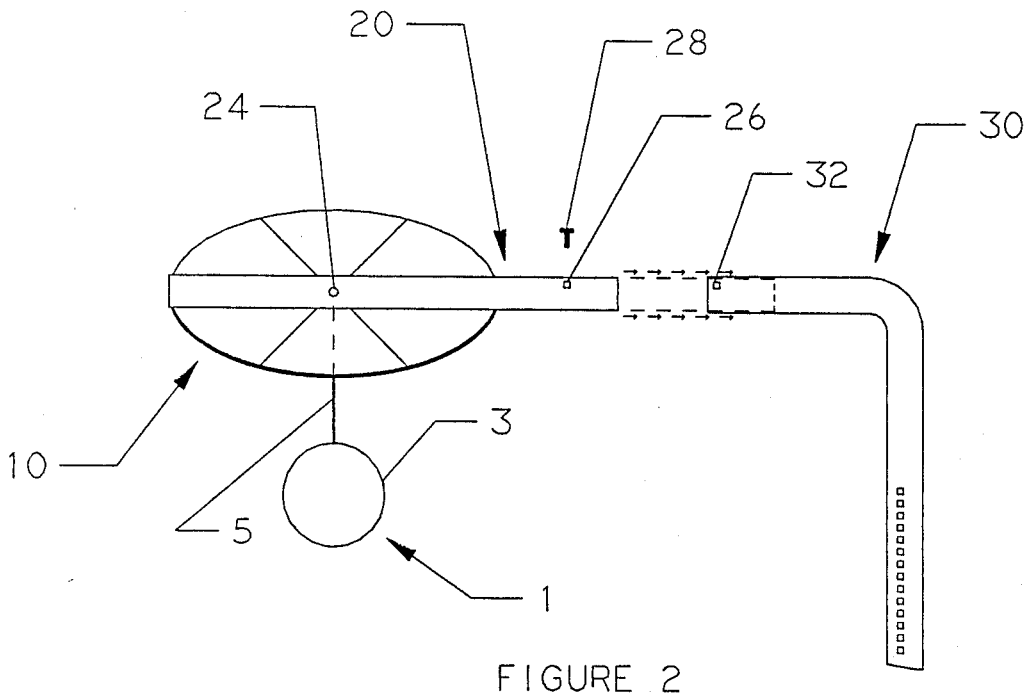
FIG. 2 is an exploded view of the two members of the preferred embodiment of the practice device illustrating how they are attached to one another.

The general nature of the preferred embodiment of the practice device is illustrated on FIG. 1. A volleyball 1 is contained within ball holder 3 that is attached to flexible funicular rod 5. Flexible funicular rod 5 is attached to rope 7 and the combination passes through vertical hole 24 in horizontal member 20. The attachment of flexible funicular rod 5 to rope 7 may take place below, within, or above vertical hole 24. Attached below horizontal member 20 is backstop 10. Horizontal member 20 has a cross section that fits within vertical member 30 and the two members are attached with member attachment pin 28 passing through horizontal hole 26 (in horizontal member 20) and horizontal hole 32 (in vertical member 30). The method used to attach the two members to each other is shown on FIG. 2.

Ball holder 3 may consist of any apparatus strong enough to be capable of holding volleyball 1 when it is violently struck that is of a similar compliance to that of the surface of a volleyball and that poses no hazard to the player. In the preferred embodiment, the ball holder 3 consists of a plastic mesh net bag.

Flexible funicular rod 5 may be any strong flexible cord, but an elastic flexible funicular rod 5 is preferred. In the preferred embodiment, flexible funicular rod 5 consists of surgical tubing having a nominal ½ inch (12.7 mm) diameter. The use of such surgical tubing has been found to impart particularly realistic feel to the person practicing with the device. In lieu of using surgical tubing for flexible funicular rod 5, cords, ropes, tubes, or rods made of materials having dissipative properties, such as braided rubber and fabric materials, woven or braided plastic (such as nylon) rope, plastic or fiberglass rods or tubes, or similar may be used. In the preferred embodiment, surgical tubing is attached to rope 7 primarily to save the expense of a long piece of surgical tubing.

Figure 3:
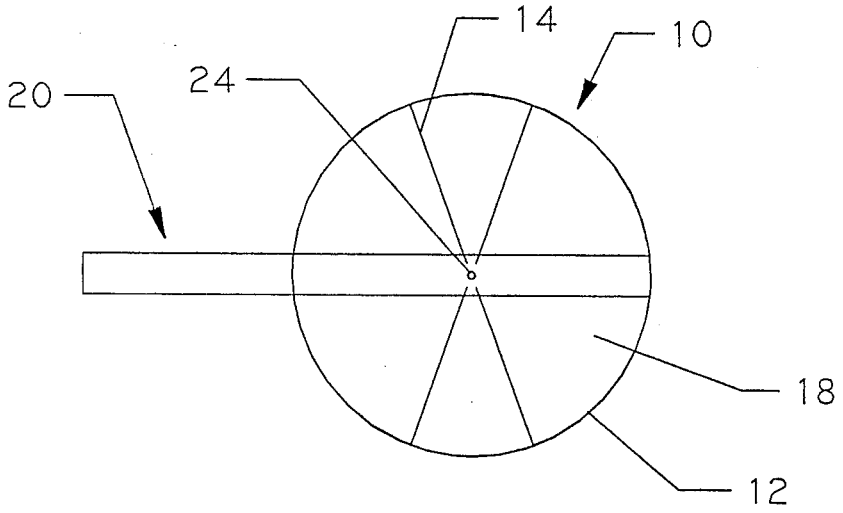
FIG. 3 is a plane view of the practice device's backstop.

FIG. 3 shows the detail of backstop 10. The backstop may be any essentially flat and horizontal shape and made of any materials that will serve quickly to dampen the motion of (dissipate the kinetic energy of) a volleyball striking the backstop. A backstop curving significantly above the horizontal is less effective in its damping role and a backstop curving significantly downward from the horizontal poses the danger of being hit by the users hand. In the preferred embodiment, backstop 10 is essentially circular, is concentric with vertical hole 24, lies in a horizontal plane, and is covered with resilient surface 18. Resilient surface 18 is stretched within hoop 12 that is supported by spokes 14. In the preferred embodiment, resilient surface 18 is a vinyl laminated fabric. A diameter for backstop 10 as small as about one meter is satisfactory. A backstop 10 with a diameter smaller than one meter is less than satisfactory because of the increased risk of injury to the player (a necessarily shorter flexible funicular rod 5 means one's hand must be closer to backstop 10) and slower damping of the volleyball 1. In the preferred embodiment, the radius of backstop 10 is about 25 inches (about 63.5 cm). The length of flexible funicular rod 5 suspended below backstop 10 plus the radius of volleyball 1 is somewhat less than the smallest distance from vertical hole 24 to the edge of backstop 10. In the preferred embodiment, the length of flexible funicular rod 5 suspended below backstop 10 is no more than about 18 inches (about 45.7 cm). Small changes in the overall height of the volleyball may be effected by small changes in the length of flexible funicular rod 5 suspended below backstop 10.

Rope 7 passes through guides 34 (placed near the elbow of vertical member 30) thence down vertical member 30. A plurality of vertically arrayed height adjustment holes 36 pierce the lower portion of vertical member 30. Vertical member 30 is held adjustably captive by bracket 40 that is clamped to end post 80. In the preferred embodiment, the cross section of at least the lower portion of the vertical member 30 is circular.

Figure 4:
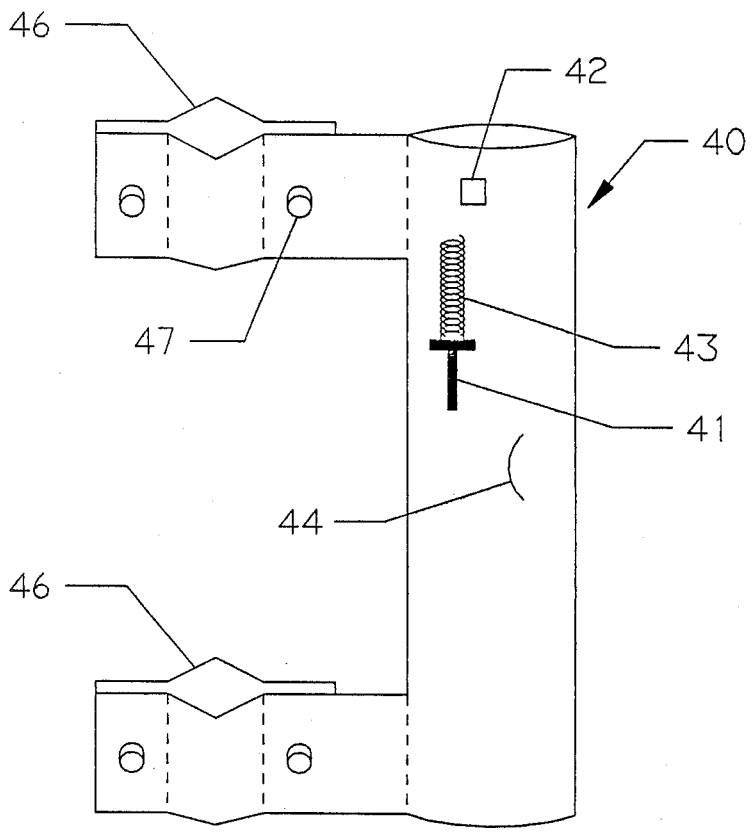
FIG. 4 is a detailed perspective view of the bracket used to attach the preferred embodiment of the practice device to an end post.

FIG. 4 shows details of bracket 40. Bracket hole 42 is aligned with an appropriate height adjustment hole 36 and vertical member 30 is retained within bracket 40 by passing height adjusting pin 41 through the aligned holes. Height adjusting pin 41 is connected to bracket 40 by chain 43 so that height adjusting pin 41 will be close at hand when the height of the practice device is being adjusted. Hook 44 is provided for securing rope 7. Bracket 40 is attached to end post 80 with clamps 46. Clamps 46 are secured by the use of cross bolts 47.

The preferred embodiment of the practice device may be assembled by a single person. A volleyball 1 is placed within ball holder 3 and the combination is attached to flexible funicular rod 5. Flexible funicular rod 5 is attached to rope 7 and the combination is threaded through vertical hole 24. Horizontal member 20 is placed within vertical member 30 with horizontal hole 26 aligned with horizontal hole 32 and the members are made fast by placing member attachment pin 28 through the aligned holes. Rope 7 is threaded through guides 34. Bracket 40 is bolted to end post 80 by using clamps 46 and cross bolts 47. Vertical member 30 is slipped within bracket 40 and height adjusting pin 41 is run through bracket hole 42 and such an aligned height adjustment hole 36 that backstop 10 is the desired height above the floor. In the preferred embodiment, backstop 10 can be as high as about 13 feet (about 4 m) above the playing floor and as low as about 8½ feet (about 2.6 m). Rope 7 is tied to hook 44 so that volleyball 1 is the proper distance below backstop 10.

Figure 5:
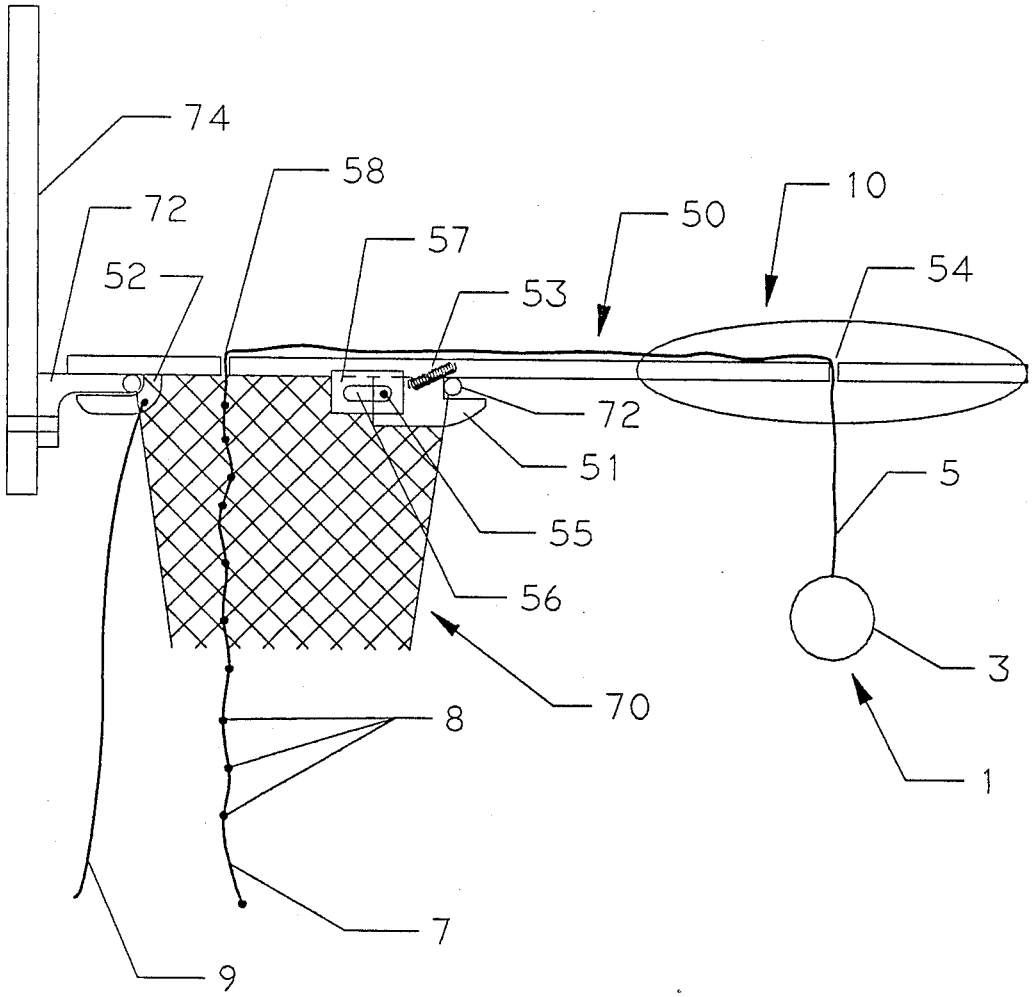
FIG. 5 is a side view of an alternative embodiment of the practice device attached to the rim of a basketball hoop.

An alternative embodiment of the present invention is shown on FIG. 5. This embodiment is adapted for mounting on the rim 72 of an existing basketball hoop 70. The rim 72 is affixed to a basketball backboard 74. This alternative embodiment is similar to the preferred embodiment except in having rim attachment arm 50 extending between rim 72 and backstop 10 in lieu of horizontal member 20 and vertical member 30 extending between end post 80 and backstop 10. Specifically: A volleyball 1 is contained within ball holder 3 that is attached to flexible funicular rod 5. Flexible funicular rod 5 is attached to rope 7 and the combination passes through vertical hole 54 in rim attachment arm 50. The attachment of flexible funicular rod 5 to rope 7 may take place below, within, or above vertical hole 54. Attached below rim attachment arm 50 is backstop 10. Backstop 10 has been discussed above and is illustrated in detail on FIG. 3.

Rim attachment arm 50, in the preferred version of this alternative embodiment, is an essentially straight member attached at one end to and above backstop 10 and having attached near its other end rear hook 52 opening away from backstop 10. Rear hook 52 is placed under the rim 72 of basketball hoop 70. Safety rope 9 is attached near the end of rim attachment arm 50 most distant from backstop 10. Rim attachment arm 50 is also provided with a slidable captive front hook 51 that opens towards backstop 10 and that is forced towards backstop 10. Front hook 51 is placed under the rim 72 of basketball hoop 70 directly opposite rear hook 52. Front hook 51 is slidably secured to rim attachment arm 50, and urged towards basketball hoop 70, so as firmly to join rim attachment arm 50 to basketball hoop 70. In the preferred version of this alternate embodiment, front hook 51 is provided with side ears 55 that are capable of captively sliding within longitudinal slot 56 present within side bracket 57 that is mounted on the side of rim attachment arm 50 and thus front hook 51 is slidably secured to rim attachment arm 50. A spring 53 is also provided that is attached between front hook 51 and rim attachment arm 50 so as to force front hook 51 towards backstop 10 and thus firmly to join rim attachment arm 50 to basketball hoop 70. The placement of side bracket 57 and the width of longitudinal slot 56 is such that with front hook 51 fully forward (toward backstop 10) both rear hook 52 and front hook 51 can be under rim 72 and with front hook 51 fully to the rear both rear hook 52 and front hook 51 can pass by and within a diameter of rim 72. One skilled in the art will recognize other schemes of slidably securing front hook 51 to rim attachment arm 50, other schemes for urging front hook 51 against basketball hoop 70, and other schemes to insure that the device is secured within rim 72 when front hook 51 is full forward while allowing the passage within rim 72 of both hooks when front hook 51 is full rearward.

A knot hole 58 is provided over basketball hoop 70 and in rim attachment arm 50 to slidably contain rope 7. Rope 7 has knots 8 at spaced intervals near knot hole 58 to facilitate setting the height of volleyball 1. Knots 8 can be temporarily wedged immediately below knot hole 58 by a person on the ground. Rope 7 may be secured to a convenient point after the height of volleyball 1 has been adjusted.

This alternate embodiment of the practice device may be assembled and erected by one person. A volleyball 1 is placed within ball holder 3 and flexible funicular rod 5 is attached between ball holder 3 and rope 7. Flexible funicular rod 5 and/or rope 7 is threaded through vertical hole 54 and knot hole 58. The entire device is placed flat on the ground underneath basketball hoop 70 and then tipped to a vertical position with backstop 10 down. The entire device is rased vertically into the air and hooked onto the front of rim 72 of basketball hoop 70 with front hook 51. Front hook 51 will slide the maximum amount allowed by longitudinal slot 56 and side ears 55 away from backstop 10 under the force of gravity on the entire device. Safety rope 9 is pulled downward, pivoting the entire device around front hook 51, until rim attachment arm 50 is flat against rim 72 and then safety rope 9 is pulled in a direction away from backstop 10 until rear hook 52 is under rim 72. Rope 7 is used to adjust volleyball 1 to the proper height and then is then secured.

The preferred embodiment and an alternate embodiment of the present invention have been described in detail. The embodiments described are illustrative and not restrictive.

We claim:

1. A volleyball practice device, utilizing a volleyball, an attachment point, and a floor, comprising:

retaining means for holding the volleyball;

a resilient backstop extending essentially horizontally and having a centrally located orifice;

a flexible funicular rod one end of which is attached to said retaining means and the other end of which passes upward through said orifice of said backstop terminating on the attachment point; and supporting means attached to said backstop for suspending said backstop an adjustable distance from the floor.

2. A volleyball practice device as recited in claim 1, wherein said retaining means for holding the volleyball consists of a plastic mesh bag.

3. A volleyball practice device as recited in claim 1, wherein said backstop is essentially circular.

4. A volleyball practice device as recited in claim 3, wherein the diameter of said backstop is not less than one meter.

5. A volleyball practice device as recited in claim 3, wherein said backstop comprises:

an essentially circular hoop;

a plurality of spokes emanating from the center of said backstop terminating on said hoop; and fabric attached to said hoop and stretched within said hoop below said spokes.

6. A volleyball practice device as recited in claim 5, wherein said fabric consists of vinyl laminated fabric.

7. A volleyball practice device as recited in claim 1, wherein said flexible funicular rod is elastic.

8. A volleyball practice device as recited in claim 7, wherein said flexible funicular rod is selected from the group consisting of surgical tubing, rubber and fabric braided together, woven or braided plastic rope, and fiberglass rod.

9. A volleyball practice device as recited in claim 1, wherein the length of said flexible funicular rod extending below said backstop is no more than the smallest distance from said orifice of said backstop to the edge of said backstop reduced by the radius of the volleyball.

10. A volleyball practice device, utilizing a volleyball, an attachment point, and a post extending vertically from the ground, comprising:

retaining means for holding the volleyball;

a resilient backstop extending essentially horizontally and having a centrally located orifice;

a flexible funicular rod one end of which is attached to said retaining means and the other end of which passes upward through said orifice of said backstop terminating on the attachment point;

a tubular supporting member having a top end attached to said backstop thence curving above and away from said backstop terminating in a bottom end that is below and displaced vertically from said backstop; and a bracket, said bracket having clamping means for attachment to the post and having adjustable holding means for receiving and keeping said supporting member.

11. A volleyball practice device as recited in claim 10, wherein said retaining means for holding the volleyball consists of a plastic mesh bag.

12. A volleyball practice device as recited in claim 10, wherein said backstop is essentially circular.

13. A volleyball practice device as recited in claim 12, wherein the diameter of said backstop is not less than one meter.

14. A volleyball practice device as recited in claim 12, wherein said backstop comprises:

an essentially circular hoop;

a plurality of spokes emanating from the center of said backstop terminating on said hoop; and fabric attached to said hoop and stretched within said hoop below said spokes.

15. A volleyball practice device as recited in claim 14, wherein said fabric consists of vinyl laminated fabric.

16. A volleyball practice device as recited in claim 10, wherein said flexible funicular rod is elastic.

17. A volleyball practice device as recited in claim 16, wherein said flexible funicular rod is selected from the group consisting of surgical tubing, rubber and fabric braided together, woven or braided plastic rope, and fiberglass rod.

18. A volleyball practice device as recited in claim 10, wherein the length of said flexible funicular rod extending below said backstop is no more than the smallest distance from said orifice of said backstop to the edge of said backstop reduced by the radius of the volleyball.

19. A volleyball practice device as recited in claim 10, wherein said holding means of said bracket comprises a hollow tube capable of snugly surrounding said supporting member, said tube being pierced by an essentially horizontal opening;

wherein said supporting member is pierced by a plurality of vertically spaced essentially horizontal orifices each capable of coaxial alignment with said opening of said tube; and further comprising a pin capable of passing through said opening and one of said orifices so as to prevent movement of said supporting member with respect to said bracket.

20. A volleyball practice device, utilizing a volleyball, an attachment point, and a basketball hoop having a rim, comprising:

retaining means for holding the volleyball;

a resilient backstop extending essentially horizontally and having a centrally located orifice;

a flexible funicular rod one end of which is attached to said retaining means and the other end of which passes upward through said orifice of said backstop terminating on the attachment point;

a supporting member having a top end attached to said backstop thence extending above and away from said backstop, above and across a diameter of the rim of the basketball hoop, and terminating in a rear hook having an opening slightly larger than the thickness of the rim and facing away from said backstop, said hook is placed under the rim of the basketball hoop; and adjustable clamping means for attaching said supporting member to the rim of the basketball hoop.

21. A volleyball practice device as recited in claim 20, wherein said retaining means for holding the volleyball consists of a plastic mesh bag.

22. A volleyball practice device as recited in claim 20, wherein said backstop is essentially circular.

23. A volleyball practice device as recited in claim 22, wherein the diameter of said backstop is not less than one meter.

24. A volleyball practice device as recited in claim 22, wherein said backstop comprises:

an essentially circular hoop;

a plurality of spokes emanating from the center of said backstop terminating on said hoop; and fabric attached to said hoop and stretched within said hoop below said spokes.

25. A volleyball practice device as recited in claim 24, wherein said fabric consists of vinyl laminated fabric.

26. A volleyball practice device as recited in claim 20, wherein said flexible funicular rod is elastic.

27. A volleyball practice device as recited in claim 26, wherein said flexible funicular rod is selected from the group consisting of surgical tubing, rubber and fabric braided together, woven or braided plastic rope, and fiberglass rod.

28. A volleyball practice device as recited in claim 20, wherein the length of said flexible funicular rod extending below said backstop is no more than the smallest distance from said orifice of said backstop to the edge of said backstop reduced by the radius of the volleyball.

29. A volleyball practice device as recited in claim 20, wherein said adjustable clamping means comprises:

a sliding hook having an opening slightly larger than the thickness of the rim and facing said backstop, said sliding hook disposed below said supporting member and capable of captively sliding along the longitudinal axis of said supporting member;

a forcing means between said sliding hook and said supporting member for urging said sliding hook against the rim of the basketball hoop; and a means for restricting the position and length of travel of said sliding hook, relative to said rear hook, to a maximum distance between said opening of said sliding hook and said opening of said rear hook of at least the diameter of the rim, and to a minimum distance such that all of said sliding hook and all of said rear hook may freely pass within the diameter of the rim of the basketball hoop.

* * * * *

UNITED STATES PATENT AND TRADEMARK OFFICE

CERTIFICATE OF CORRECTION

PATENT NO. : 4,948,150

DATED : August 14, 1990

INVENTOR(S) : Daly, Jr. et al

It is certified that error appears in the above-identified patent and that said Letters Patent is hereby corrected as shown below:

Column 3, line 23, insert an apostrophe after the "r" in "users".

Column 5, line 6, interchange "to" and "slidably".

Column 5, line 32, delete the last "then" (next to the last word on the line)

Signed and Sealed this

Twenty-fourth Day of December, 1991

*Attest:*

HARRY F. MANBECK, JR.

*Attesting Officer*

*Commissioner of Patents and Trademarks*